US005669313A

United States Patent [19]

Cottingham

[11] Patent Number: 5,669,313

[45] Date of Patent: Sep. 23, 1997

[54] TUB TABLE

[76] Inventor: David Cottingham, A1 80 Galbraith Dr. SW., Calgary, Alberta, Canada, T3E 3H2

[21] Appl. No.: 613,634

[22] Filed: Mar. 11, 1996

[51] Int. Cl.[6] ..... A47B 23/00

[52] U.S. Cl. ..... 108/42

[58] Field of Search ..... 108/42, 43; 4/548, 4/547, 546, 551, 579, 578.1, 571.1

[56] References Cited

U.S. PATENT DOCUMENTS

| | | | |
|---|---|---|---|
| 2,237,076 | 4/1941 | Kenney et al. | 4/579 X |
| 2,590,732 | 3/1952 | Simancik | 108/43 X |
| 2,783,109 | 2/1957 | Frey | 108/43 |
| 2,808,191 | 10/1957 | Cramer | 108/43 X |
| 3,086,221 | 4/1963 | Gass | 4/579 |
| 3,950,793 | 4/1976 | Adams | 4/548 X |
| 4,494,755 | 1/1985 | Caillouet, Jr. | 108/43 X |
| 4,939,799 | 7/1990 | Van Hovel | 4/579 X |
| 4,975,991 | 12/1990 | Peterson | 4/579 |
| 5,127,339 | 7/1992 | Hood, Jr. | 108/42 X |
| 5,433,152 | 7/1995 | Henry | 108/42 |

FOREIGN PATENT DOCUMENTS

| | | | |
|---|---|---|---|
| 1580482 | 7/1969 | France | 108/42 |
| 2520998 | 8/1983 | France | 4/548 |

*Primary Examiner*—Jose V. Chen

*Attorney, Agent, or Firm*—David S. Thompson

[57] ABSTRACT

A tub table for erectly supporting an open book on a bathtub. The Tub Table has a planar member adapted to slide on the top side portion of the bath tub which has a length extending generally across the width of the bathtub, and a lateral trough extending across a central front portion thereof adapted to erectly support the open book. In the preferred embodiment the Tub Table is molded from plastic and has a peripheral top rim in which handles are formed therein on opposite ends. Two curved ridges adapted to extend below the top rim of the bathtub and maintain the tub table on the tub when it is slid therealong, extend downwardly from the bottom side portion of the tub table. The curved ridges may have feet on opposite ends to support the Tub Table on a supporting surface when it is not positioned on the bathtub.

5 Claims, 1 Drawing Sheet

TUB TABLE

BACKGROUND OF THE INVENTION

This invention relates to bathtub accessories and more particularly bathtub tables.

The idea of a tub table is not new. On the market today there are tub tables which are mostly of a wire basket design. One problem with these tub tables is that they do not perform an effective job of keeping the contents on the table dry. Another problem with these tub tables is that they are unable to support a book in a comfortable reading position.

OBJECTS AND STATEMENT OF THE INVENTION

It is an object of this invention to disclose a simple and rugged design for a tub table. It is an object of this invention to disclose a design for a tub table which can comfortably position and erectly support any size of a magazine or book and which has a slim and singular piece design. It is a further object of this invention to disclose a tub table which can be loaded and slid along the top of a bathtub to facilitate entry or egress from the tub while it rests on the top side portion of the bathtub. It is a final object of this invention to disclose a design for a tub table which is highly functional, rugged, easily stored, and fashionably attractive but which can be inexpensively produced.

One aspect of this invention provides for a tub table for erectly supporting an open book on a bathtub which comprises a planar member adapted to slide on the top side portion of the bathtub having a length extending generally across the width of the bathtub, and a lateral trough extending across a central front portion thereof adapted to erectly support the open book.

A preferred aspect of this invention provides for a tub table fabricated from molded plastic having a peripheral top rim and handles formed in a central portion of the top rim at opposite ends of the length of the tub table. The rear portion of the trough extends down angularly to hold the open book in an angularly erect position suitable for reading. Two curved ridges extend downwardly from the tub table's bottom side portion. In use, said ridges extend below the top rim of the tub to maintain the tub table on the tub when it is slid therealong.

Various other objects, advantages and features of this invention will become apparent to those skilled in the art from the following description in conjunction with the accompanying drawings.

FIGURES OF THE INVENTION

Figure 1:
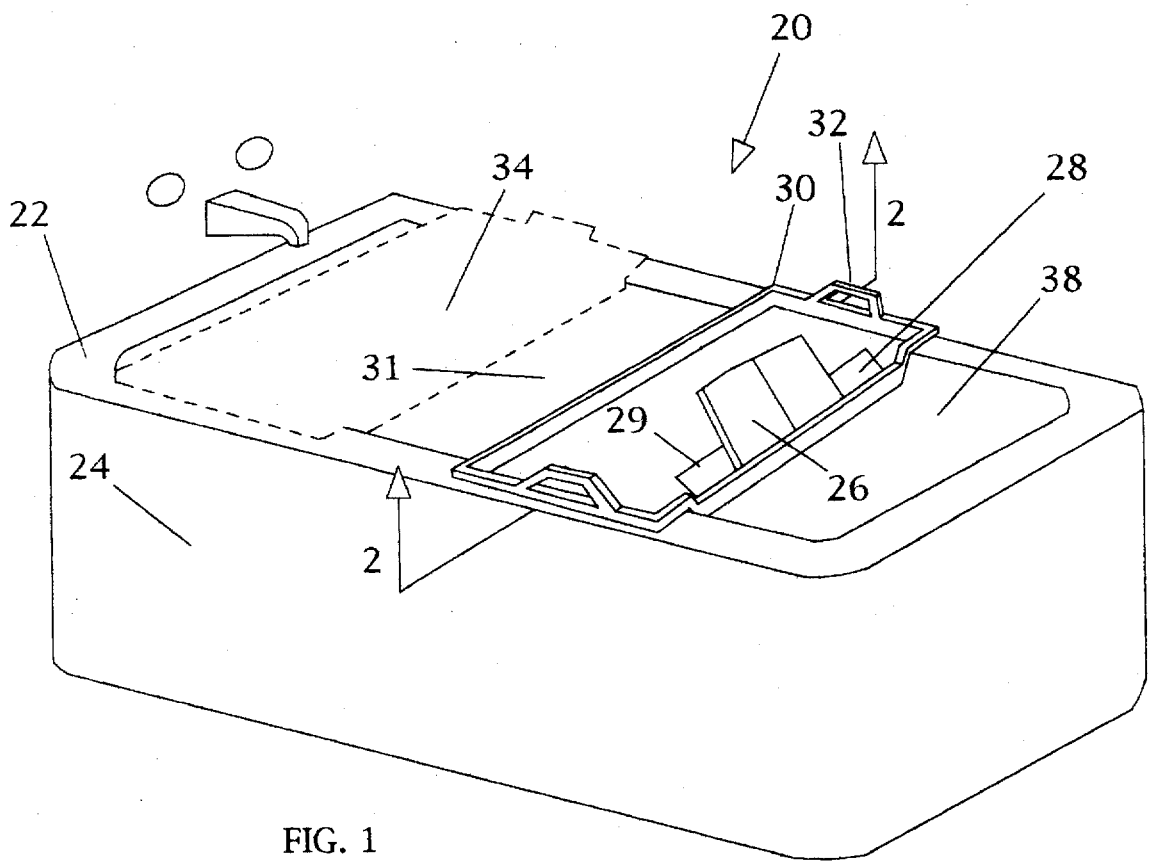

FIG. 1 a perspective view of a Tub Table slidably positioned on the top side portion of a bathtub.

Figure 2:
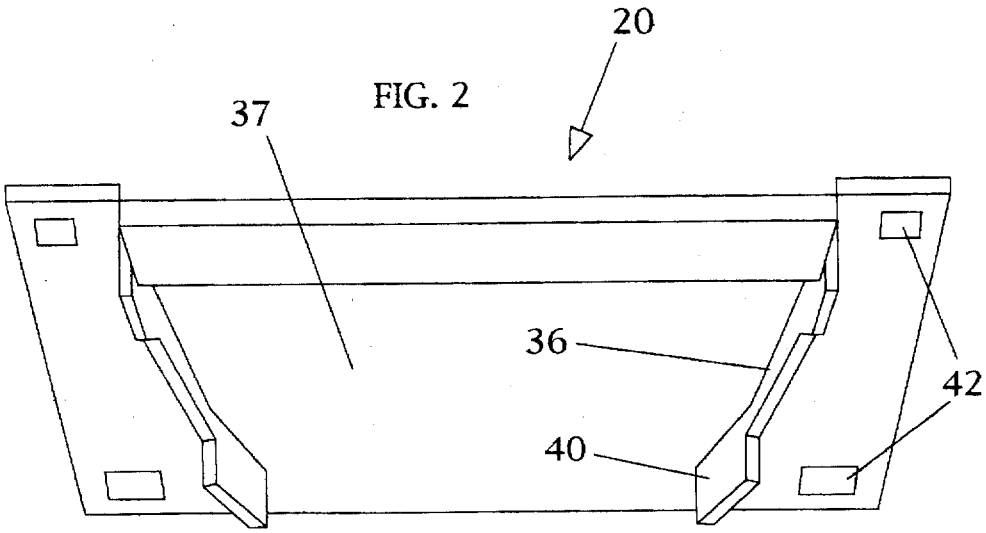

FIG. 2 is a bottom perspective view of the Tub Table shown in FIG. 1 viewed from below along lines 2—2.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a Tub Table 20 slidably seated on the top side portion 22 of a bathtub 24. A book 26 is shown seated in a lateral trough 28. The lateral trough 28 holds the book 26 in an erect position which is comfortable for reading by an individual seated soaking in warm water 31 in the bath tub 24. In the preferred embodiment, the Tub Table 20 measures 26¾ inches long across the width of the bathtub 24 by 14 inches deep measured along the length of the bathtub 24. The lateral trough 28 is generally about 12 to 15 inches in length and extends across the central portion of the length of the Tub Table 20. The rear portion 29 of the trough 20 extends down angularly, at an angle similar to the erect book 26. However, measured vertically the trough 28 is only about 1 to 2 inches in depth. The Tub Table 20 is provided with a ½ inch peripheral top rim 30. At opposite ends of the length of the Tub Table 20 a central portion of the top rim 30 rises up to form sturdy handles 32 suitable for lifting and placing the Tub Table 20 on the bathtub 24. This top rim 30 also extends across the front portion of the trough 28 to hold the bottom portion of the face of the open book 26.

The Tub Table 20 can slide freely along the length of the top side portion of the bathtub 24. This allows the Tub Table to be best positioned to facilitate the comfort of the bather. If, for example, the bather prefers to lean back and lower himself into the water, the Tub Table 20 can easily be slid forward and then rearwardly to an optimum position after the bather is comfortable. The loaded Tub Table 20 is shown in ghost slid forward to an extreme position 34. This position is preferable for entry or egress from the bathtub 24.

FIG. 2 is a bottom perspective view showing the bottom side portion 37 of the Tub Table shown in FIG. 1 taken along line 2—2 therein. Curved ridges 36, each about 12 inches in length, extend from approximately 1 inch from the front to 1 inch from the back of the Tub Table 20. The curved ridges 36 are spaced apart so that they fit closely against and between the interior of the walls 38 of the bathtub 24. Short 3-inch high legs 40 form end portions of the curved ridges 36. These short legs 40 can be used to horizontally support the loaded Tub Table 20 after it is lifted off the bathtub 24 and laid on a flat supporting surface (not shown).

The curved ridges 36 are spaced to extend generally between the interior of the tub walls 38 on a standard bathtub 24. At the front of the Tub Table 20 the curved ridges 36 are spaced so that there outside portions are generally 22½ inches apart. At the rear of the Tub Table 20 the ridges curve inward, similar to the inner contour of a standard bathtub 24 at the drain end. This enables the Tub Table 20 to be slid to an extreme forward position for entry or egress from the bathtub 24.

The Tub Table 20 is molded from a rigid plastic. This results in a lightweight and durable tray. The Tub Table 20 can be white, beige, grey, rose, or any color chosen to compliment the color schemes of bathrooms. The Tub Table 20 may be hung from one of its handles 32 by a hook or alternatively stored in a closet or vanity cabinet when not in use. Textured rubber pads 42 could be provided on the bottom side portion 37 of the Tub Table 20 to prevent the Tub Table 20 from sliding too easily on the top side portion 22 of the bathtub 24.

While the invention has been described with preferred specific embodiments thereof, it will be understood that this description is intended to illustrate and not to limit the scope of the invention, which is defined by the following claims.

I claim:

1. A tub table comprising:

(a) a planar member, having a bottom side portion, the planar member adapted to slide on opposed top sides of a bathtub, the planar member having a length sufficient to extend between the top side portions of opposed elongate walls of the bathtub, and (b) a lateral trough extending across a central front portion of the planar member, the lateral trough having a length and two ends adapted to engage the opposed elongate walls of the bathtub, thereby allowing the lateral trough to be in contact with the opposed elongate walls of the bathtub, thereby preventing the tub table from falling into the bathtub, the lateral trough sized to support an open book, having a rear portion which extends down angularly to support the open book in an angularly erect position suitable for reading;

(c) a peripheral top rim, a portion of the peripheral top rim adjacent to the lateral trough;

(d) handles formed in a central portion of the peripheral top rim as opposed ends of the tub table;

(e) first and second curved ridges attached to the lateral trough and extending downwardly from the bottom side portion of the planar member, the first and second ridges adapted to extend below to define engaging means for engaging the top side portion of the bathtub, thereby positionally maintaining the tub table on the bathtub.

2. A tub table as in claim 1 wherein a front portion of each curved ridge angles inwardly to allow the tub table to slide into a rounded front interior of the bathtub.

3. A tub table as in claim 2 wherein end portions of the curved ridges extend downwardly to form short legs, thereby supporting the tub table when the tub table is not seated on the bathtub.

4. A tub table as in claim 3 further comprising rubber pads positioned on the bottom side portion of the tub table to prevent the tub table from sliding too easily on the top side portion of the bathtub.

5. A tub table adapted for erectly supporting an open book, and adapted to be mounted on a bathtub, the bathtub having first and second opposed elongate walls, the walls having an interior surface and a top side portion, the bathtub further having a length and a width, the tub table comprising:

(a) a planar member, having a bottom side portion, the planar member adapted to slide on the top side portion of the bathtub, the planar member having a length sufficient to extend between top side portions of opposed elongate walls of the bathtub;

(b) a lateral trough, having opposed ends, the lateral trough extending across a central front portion of the planar member, the lateral trough having a length and two ends adapted to engage with the opposed elongate walls of the bathtub, thereby preventing the tub table from falling into the bathtub, the lateral trough sized to support the open book;

(c) a peripheral top rim, carried by the planar member, wherein a portion of the peripheral top rim is adjacent to the lateral trough;

(d) at least one handle formed in a central portion of the peripheral top rim, thereby allowing the tub table to be easily carried;

(e) first and second curved ridges extending downwardly from the bottom side portion of the tub table, the first and second curved ridges attached to opposed ends of the lateral trough, wherein the ridges define engaging means below the top side portions of the tub when the tub table is mounted on the sized to extend bathtub, thereby positionally maintaining the tub table on the bathtub, the first and second curved ridges additionally comprising:

(a) a front portion angled inwardly to allow the tub table to slide into a rounded front interior of the bathtub; and (b) end portions extending downwardly to form short legs, thereby supporting the tub table when the tub table is not seated on the bathtub; and (f) rubber pad means, positioned on the bottom side portion of the tub table, for preventing the tub table from sliding too easily on the top side portion of the bathtub.

* * * * *